United States Patent [19]

Usami

[11] Patent Number: 4,627,712

[45] Date of Patent: Dec. 9, 1986

[54] IMAGE DENSITY CONTROL APPARATUS

[75] Inventor: Akihiro Usami, Yokohama, Japan

[73] Assignee: Canon Kabushiki Kaisha, Tokyo, Japan

[21] Appl. No.: 636,493

[22] Filed: Aug. 1, 1984

[30] Foreign Application Priority Data

Aug. 6, 1983 [JP] Japan ..... 58-144121
Aug. 6, 1983 [JP] Japan ..... 58-144122

[51] Int. Cl.[4] ..... G03G 15/00

[52] U.S. Cl. ..... 355/14 R; 355/14 C; 355/14 E; 355/14 D

[58] Field of Search ..... 355/14 R, 14 C, 3 R, 355/14 E, 14 D, 68

[56] References Cited

U.S. PATENT DOCUMENTS 3,926,518 12/1975 Berry et al. ..... 355/68 X
4,153,364 5/1979 Suzuki et al. ..... 355/68 X
4,200,391 4/1980 Sakamoto et al. ..... 355/14 E
4,239,374 12/1980 Tatsumi et al. ..... 355/14 D X
4,352,553 10/1982 Hirahara ..... 355/14 E
4,354,758 10/1982 Futaki ..... 355/68 X
4,472,046 9/1984 Kohyama ..... 355/3 R X

*Primary Examiner*—A. C. Prescott
*Attorney, Agent, or Firm*—Fitzpatrick, Cella, Harper & Scinto

[57] ABSTRACT

Image density control apparatus including a photosensor for detecting a density of an image of an original, and a microcomputer for controlling a light intensity of a light source of a development bias voltage. The microcomputer has a CPU for determining a control output in response to a detection signal from the photosensor and in response to signals from a ROM corresponding to respective positions on the image of the original.

9 Claims, 12 Drawing Figures

IMAGE DENSITY CONTROL APPARATUS

BACKGROUND OF THE INVENTION

1. Field of the Invention

The present invention relates to an image control apparatus for obtaining a copy having an image of proper density.

2. Description of the Prior Art

In an apparatus of the type described above, a photodetecting means or a latent image potential detecting means of a photosensitive drum first measures a density of reflected light from an image on an original or a portion thereof. Then, a light source for illuminating an original or a development bias is controlled according to a detection signal, and a light intensity of the light source or the development bias voltage is set, thereby obtaining an image having a proper density.

However, according to this method, if the original has an image whose respective portions have different densities, a portion having a low density is copied to be too dark, and a portion having a high density is copied to be too light. Also, a density of reflected light from an image on the original is measured by the photodetecting means or the latent image potential detecting means of the photosensitive drum upon performing the copy operation, and simultaneously, the light intensity of the light source or the development bias is controlled according to the measured density, thereby obtaining an image having a predetermined density. However, in this method, when the original has an image whose respective portions have different densities, considerable density variations occur undesirably.

Such a conventional apparatus has a special detecting means for detecting a density or a contrast of an image on an original. In accordance with information of the density or the contrast of the original obtained from the detecting means, an application voltage of the light source for illuminating an original or the development bias voltage is controlled so as to obtain a copy having a proper density. However, even if the application voltage or the development bias voltage is controlled in such a manner, not all originals result in images with good contrast. In a conventional copying machine, the copy operation is unsatisfactorily performed to produce an original having such a poor contrast image.

SUMMARY OF THE INVENTION

It is an object or the present invention to provide an image control apparatus in which the above disadvantages are eliminated.

It is another object of the present invention to provide an image control apparatus in which a density balance, that is, a proper density corresponding to a density difference in each portion of an image on an original can be obtained, and a density variation thereof can be controlled.

It is still another object of the present invention to provide an image control apparatus which can indicate to an operator that a desired contrast cannot be obtained even if the image control operation is performed.

It is still another object of the present invention to provide an image control apparatus which provides an image of a density corresponding to each portion of the original, by detecting and sampling a density of the image on the original at a predetermined period and processing the obtained signal, thereby controlling a density variation of the image.

It is still another object of the present invention to provide an image control apparatus which warns an operator that an image formed on an original has a too low contrast, thereby preventing him from wasting paper sheets.

The above and other objects will be apparent from the following description of the preferred embodiments.

DETAILED DESCRIPTION OF THE PREFERRED EMBODIMENTS

Figure 1:
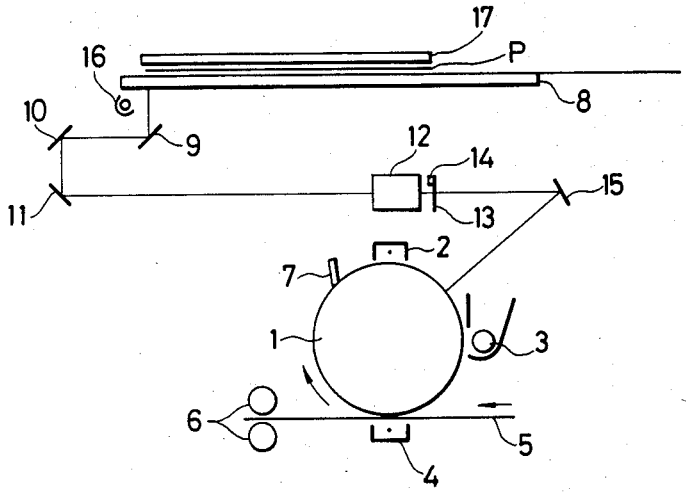
FIG. 1 is a sectional view of a copying machine according to an embodiment of the present invention.

FIG. 1 is a sectional view of a copying machine according to an embodiment of the present invention. A drum 1 having an electrophotographic photosensitive body is rotated in a direction indicated by the arrow shown in FIG. 1.

The drum 1 is uniformly charged by a charger 2 and an original image is slit-exposed. A latent image obtained from this exposure is developed by a developer 3, thereby obtaining a toner image. The toner image is transferred to a copying paper sheet 5 by a transfer charger 4. The paper sheet 5 is conveyed to a pair of fixing rollers 6 so as to fix the toner image thereon. The residual toner on the drum 1 is cleaned off by a cleaning blade 7 in order to allow the drum 1 to be subjected to another image forming operation. An orignal O to be copied is placed on a glass platen 8 by an automatic original feed mechanism. After the exposure operation, the original O is discharged and another original is placed on the glass platen 8.

When a copy start button is depressed, a first mirror 9 and second and third mirrors 10 and 11 perform a prescanning operation of an original at a shift speed ratio of 2:1. During the prescanning operation, a photodetecting means 14 such as a photosensor detects a light amount at a predetermined period so as to sample data.

Figure 2:
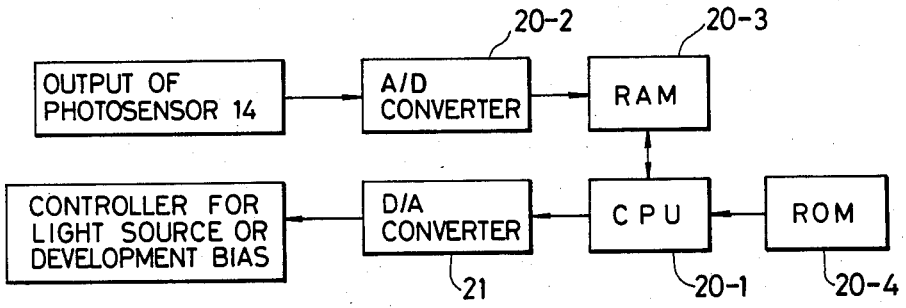
FIG. 2 is a block diagram of a control circuit.

FIG. 2 is a control block diagram. A CPU 20-1 is a processor which processes a signal from the detecting means 14 and controls an output to a light source 16. The sampled data are sequentially stored at the respective addresses of a RAM 20-3 corresponding to respective reading positions on the original. This prescanning operation is repeated until all the portions of the image on the original O are scanned. Each data stored in the RAM 20-3 includes a density of reflected light from the image on the original O and the reading position thereof. When the prescanning operation is finished, the data stored in the RAM 20-3 are averaged by the CPU 20-1. Differences between the means value and the data stored in the RAM 20-3 are calculated by the CPU 20-1. The calculation results are also stored at corresponding addresses of the RAM 20-3. A voltage of the light source 16 or a development bias voltage is determined with reference to the mean value.

When an actual exposure scanning is started, the difference data described above are read out in synchronism with a store timing. A coefficient $\alpha$ is multiplied by the difference data and the multiplied value or product is added or subtracted to or from the voltage of the light source 16 or the development bias voltage, thereby controlling the light intensity of the light source 16 or the development bias so as to obtain a proper copy density. The processing means described above is stored in a ROM 20-4.

Figure 3:
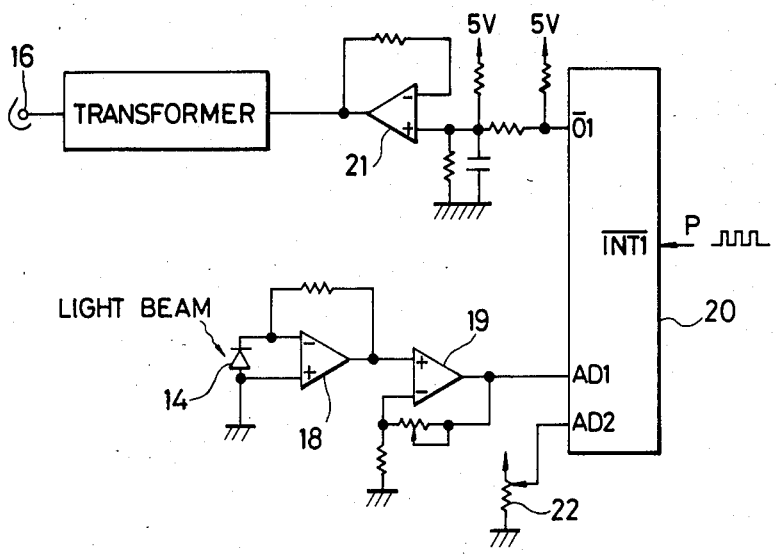
FIG. 3 is a circuit diagram of the control circuit of FIG. 2.

FIG. 3 is a control circuit diagram. A microcomputer 20 includes an A/D converter 20-2, the ROM 20-4 and the RAM 20-3. An interruption port $\overline{\text{INT1}}$ receives repetitive pulses P for performing the interruption operation, thereby performing the sampling operation of detection data. Operational amplifiers 18 and 19 amplify and correct a detection singal. An operational amplifier 21 D/A converts the output data. An input resistor 22 presets the number of sampling operations. A/D conversion input ports AD1 and AD2 are respectively connected to the operational amplifier 19 and the input resistor 22. The pulse P may be a clock pulse repeatedly generated in accordance with the movement of an optical system or a clock pulse of an oscillator which drives the photosensitive drum or the optical system. In the case of the latter pulse in particular, positions on the image on the original precisely correspond to the pulses, thereby providing highly precise image control.

Figure 4:
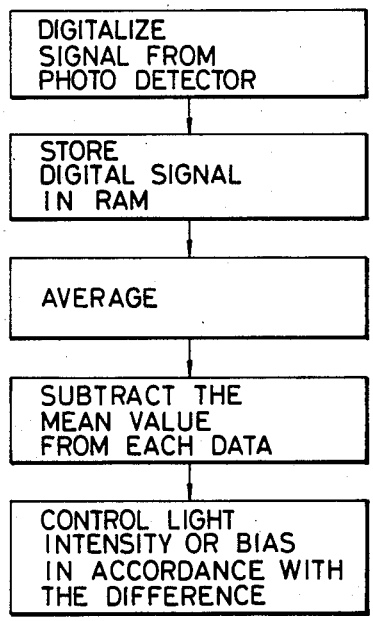
FIGS. 4, 5A and 5B are respectively flow charts for explaining the operation of the control circuit of FIG. 3.
Figure 5A:
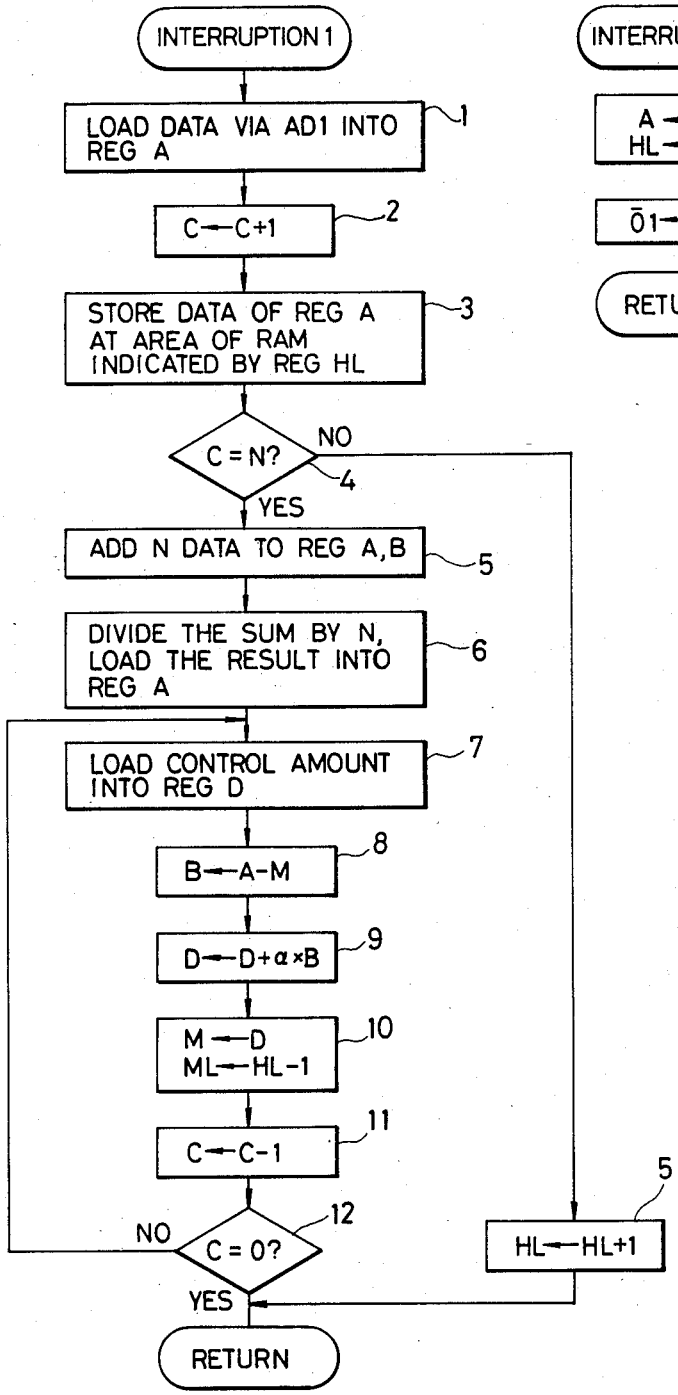
Figure 5B:
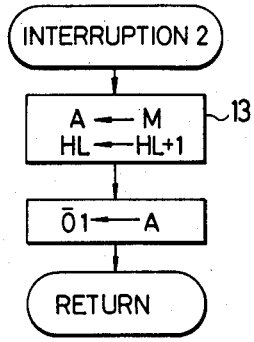

FIG. 4 is a schematic flow chart for explaining the control operation described above. FIGS. 5A and 5B are respectively flow charts for explaining program interruptions. Referring to FIG. 5A, when an original is prescanned once, an interruption is performed by external pulses at a predetermined period so as to sample detection data to provide N data. Referring to FIG. 5B, another interruption is executed to generate a signal corresponding to a light intensity of the light source 16 or a control amount of the development bias voltage, when the copying operation is performed.

In other words, when the actual exposure scanning of the optical system is started, the input port AD1 is sampled in response to the pulse P to load sample data into a register A (step 1). A register C for counting the number of sampling operations is incremented by one (step 2). Then, data of the register A is stored at the memory area of the corresponding address (which is started from 0) indicated by an address register HL of a memory M (step 3). The CPU 20-1 determines whether or not the count of the register C has reached a sampling number N (step 4). If NO is step 4, the address register HL is incremented by one (step 5), and the CPU 20-1 then waits for the pulse P to be input again. When another pulse P is input, the data is sampled and stored at the next memory area of the corresponding address of the RAM 20-3. The sample data are sequentially stored at the memory area of the corresponding address. When N data are sampled (i.e., if YES in step 4), all the sample data are added together and the sum is divided by N. The divided value is stored in the register A (steps 5 and 6). The control amount for providing a proper image which corresponds to the register A is loaded into a register D (step 7). A difference between the data in the register A and the N data in the memory M is loaded into a register B (step 8). A coefficient $\alpha$ is multiplied by the data in the register B and the multiplied result is added to the data in the register D in which the control amount is loaded, thereby obtaining precise Nth discrimination data (Nth position on the original) (step 9). The discrimination data is stored in the memory area of the memory M corresponding to the position on the original described above and the address register HL is decremented by one (step 10). The register C for counting the sampling number is decremented from N (step 11). Steps 7 to 12 are repeated until the sampling number of the register C is decremented to reach zero (step 12). Thus, proper control values are stored at the memory areas of the addresses corresponding to the positions on the original. After storing the proper control values, when the main scanning operation of the original is performed and the pulse P is input again, the addresses of the memory are sequentially advanced upon reception of every pulse P. Then, the control data of the memory M are sequentially loaded in the register A and a control output is generated from an output port $\overline{\text{O1}}$. Therefore, proper control of the light source or the bias voltage can be performed in correspondence with the density at each position on the original.

In this case, in a main flow chart (not shown), enabled states of interruptions 1 and 2 are set by detecting, by an optical system detecting means, that the optical system is released from a scanning start position. Therefore, the sampling operation can be performed upon reception of the first pulse P after starting the scanning operation, thereby performing precise control corresponding to each position on the original.

During the actual scanning operation, the density of the image formed on the original can be detected to determine the control output. This can be achieved by performing density detection and calculation of the control data before an exposed surface of the photosensitive body reaches a development range and by setting the control value before the leading end of the image reaches the development range. In this case, a combination of the sampling operation and the setting operation of the control amount described above can be repeated for an image on one original so as to detect the density of the image on this original and control it.

When a platen cover 17 does not cover the original and when the photodetecting means 14 can detect only reflected light below a predetermined black level, the CPU 20-1 determines that the original is not at that position and the development bias is disabled, so that a toner cannot be attached to the paper sheet. When a comparison of the black level is performed, data of the black level previously stored in the ROM 20-4 and the CPU 20-1 can be used to compare the sampling data with the data stored in the ROM 20-4.

Figure 6:
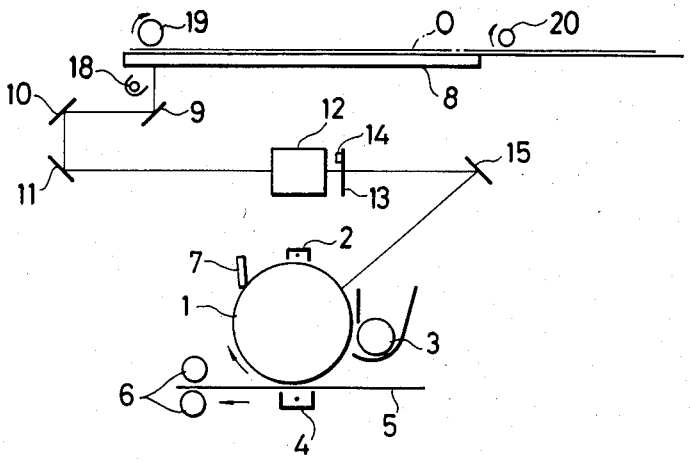
FIG. 6 is a sectional view of a copying machine according to another embodiment of the present invention.

FIG. 6 is a sectional view of a copying machine according to another embodiment of the present invention. A drum 1 having an electrophotographic photosensitive body is rotated in a direction indicated by an arrow in FIG. 6. The drum 1 is uniformly charged by a charger 2. Then, an original image is slit-exposed. A latent image obtained from this exposure is developed by a developer 3, thereby obtaining a toner image. The toner image is transferred to a copying paper sheet 5 by a transfer charger 4. The paper sheet 5 is conveyed to a pair of fixing rollers 6 so as to fix the toner image thereon. After the transfer operation, the residual toner on the drum 1 is cleaned off by a cleaning blade 7 in order to allow the drum 1 to be subjected to another image forming operation. An original O to be copied is placed on a glass platen 8.

Figure 7:
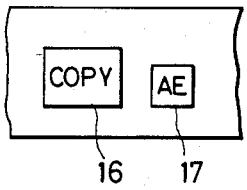
FIG. 7 is an explanatory view of an operation panel of the copying machine according to another embodiment of the present invention.

FIG. 7 shows an example of an operation panel of the copying machine. A button 16 is used for starting the copying operation and an automatic exposure (AE) button 17 is used for automatically performing the control of the light intensity of a light source 18.

An operator sequentially depresses the AE button 17 and the button 16. Then, a first mirror 9 and second and third mirrors 10 and 11 started to perform the scanning operation of the original at a shift speed ratio of 2:1. A density of an image on the original O is detected by a photodetecting means 14 placed in an optical path. After detection, the mirrors 9, 10 and 11 are returned to initial positions (i.e., scanning start positions). A light intensity of a light source 18 for illuminating the orignal O is controlled with reference to information of the image on the original O obtained from the photodetecting means 14. Then, the copying operation described above is performed. However, in the case wherein a CPU determines that the density thereof is too dark or too light to obtain a proper copy with reference to the information of the density of the image on the original O obtained by the photodetecting means 14, the AE button 17 flashes for a predetermined time period, thereby indicating to the operator that a proper copy cannot be obtained. In this state, the operator can decide whether or not to start the copying operation. If the operator depresses the button 16 again, the copying operation is immediately started. If the operator does not want to perform the copying operation, he instead depresses the AE button 17 to release the automatic exposure control and the flashing of the AE button 17 is stopped.

Figure 8:
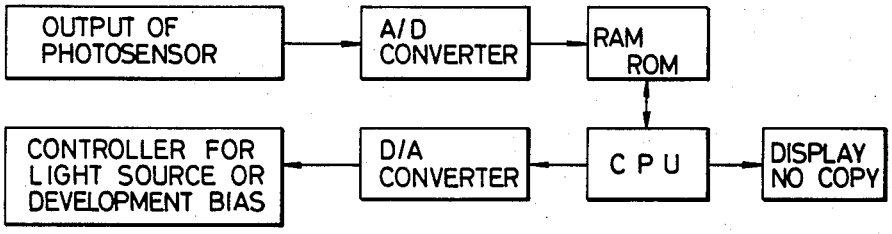
FIG. 8 is a control block diagram for explaining a method of determining an original density.
Figure 9:
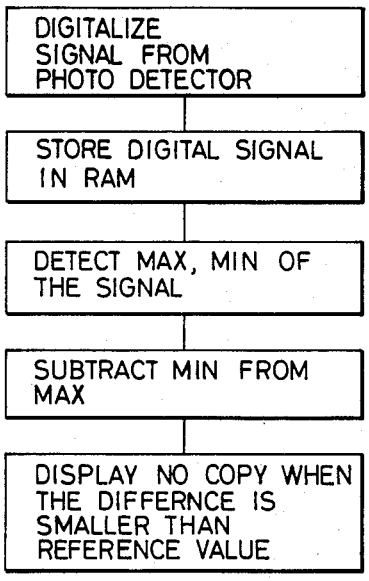
FIG. 9 is a chart for explaining a process for calculating a contrast.

FIGS. 8 and 9 are respectively control block diagrams of the operations described above. Signals from the photodetecting means 14 have a predetermined sampling period and are digitalized by an A/D converter to be sequentially stored in a RAM. When an optical system finishes the scanning operation of the original, a CPU makes a comparison of data stored in the RAM so as to detect the maximum and minimum values, and then subtracts the minimum value from the maximum value to obtain a difference therebetween. The CPU compares the difference with a reference value which is set with reference to the copying capacity of the copying machine. When the difference is smaller than the reference value, the CPU displays "no copy".

Figure 10:
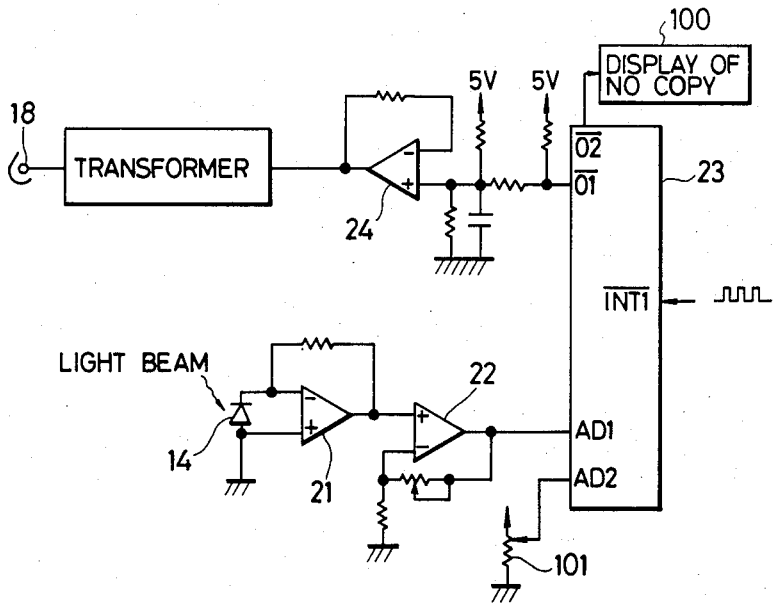
FIG. 10 is a circuit diagram of a control circuit of FIG. 8.
Figure 11:
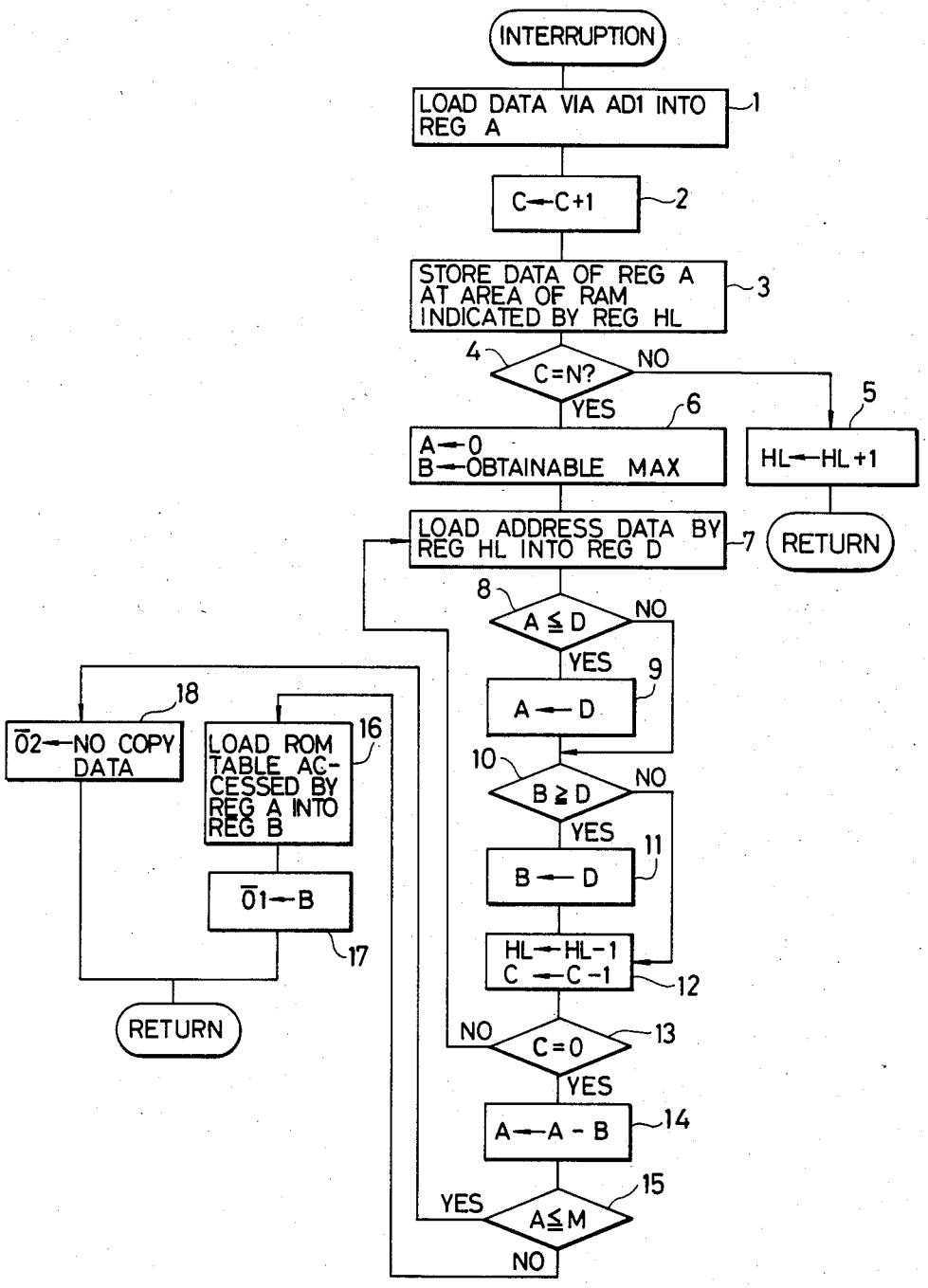
FIG. 11 is a flow chart for explaining the operation of the control circuit of FIG. 10.

FIG. 10 is a control circuit diagram of the copying machine of this embodiment. FIG. 11 is a program flow chart for explaining the operation and the control of the circuit shown in FIG. 10 using an interruption method. In FIG. 10, operational amplifiers 21 and 22 amplify the signals from the photodetecting means 14. An operational amplifier 24 performs D/A conversion of the digital data. A microcomputer 23 processes a detection signal and generates an output for properly controlling the light source or a warning output. The microcomputer 23 includes an A/D converter corresponding to input ports AD1 and AD2. The microcomputer 23 also includes a ROM storing a program of FIG. 11 and a RAM for temporarily storing detection data and calculation data. A port $\overline{\text{INT1}}$ is an interruption port for executing the flow chart of FIG. 11 upon reception of each pulse of a predetermined period. The program of FIG. 11 is executed prior to other programs.

A CPU in the microcomputer 23 senses the input port AD1 in response to a pulse received at the port $\overline{\text{INT1}}$ to load data in a register A (step 1). The CPU increments by one a register C for counting a sampling number (step 2). The detection data loaded in the register A is stored at the memory area of the corresponding address (which is started from 0) of the RAM in accordance with an address register HL which indicates the memory addresses (step 3). Then, the CPU determines whether or not the sampling number of the register C is a predetermined number N corresponding to a single original (step 4). The address register HL is sequentially incremented so as to store in the RAM values sampled upon reception of every pulse (step 5). When the sampling number reaches N, data 0 is loaded into the register A and an expected maximum value which can be detected by the sampling operation is stored in the register B (step 6). The current address of the RAM indicated by the address register HL is loaded into a register D (step 7). The data of the register A is compared with that of the register D (step 8). If YES in step 8, the data of the register D is loaded into the register A (step 9). If NO in step 8, the data of the register B is compared with that of the register D (step 10). If YES in step 10, the data of the register D is loaded into the register B (step 11). If NO in step 10, the address register HL and the register C are respectively decremented by one (step 12). Then, steps 7 to 12 are repeated until the register C is decremented to zero, that is, all the prescanning data are scanned (step 13). During this repetition, the registers A, B and D are sequentially compared so as to load new comparison values. The maximum and minimum values are respectively loaded in the registers A and B by the sampling operation. Then, the minimum value of the register A is subtracted from the maximum value of the register B to obtain a difference therebetween. The difference is loaded in the register A (step 14). When the difference is equal to or more than a predetermined value M (high contrast data) (step 15), (i.e., when the minimum potential is applied to the light source), the CPU addresses a table of the ROM by the data stored in the register A so as to load the data corresponding to the high contrast data into the register B (step 16). Then, the data corresponding to the high contrast data is generated through an output port $\overline{\text{O1}}$ (step 17). If the data of the register A is equal to or less than that of the predetermined value M (low contrast data), a warning signal is generated through an output port $\overline{\text{O2}}$ (step 18). Then, in response to this warning signal, a display circuit 100 is operated to flash the display unit provided in the AE button 17.

Note that the sampling number can be desirably set in accordance with an input signal to the input port AD 2, thereby performing suitable detection and control corresponding to different types of originals. The pulses to the port $\overline{\text{INT1}}$ can be generated in correspondence with the rotation of the photosensitive drum or can be generated in synchronism with the movement of the scanning system. However, if the sampling operation is performed in response to the pulse generated in synchronism with the movement of the scanning system, the proper divided detection of scanning surface portions can be performed. The sampling operation of the original can be performed after prescanning the original or during the time interval in which the optical system returns to the scanning start position. When the development bias is controlled, the bias control can be performed during the actual exposure scanning operation. This bias control can be achieved by terminating the sampling operation and the comparison operation for generating the comparison result during the time interval before an exposed surface of the photosensitive body reaches a development range.

Instead of flashing the AE button, a statement that a proper copy cannot be obtained may be given to an operator in an audio manner, thereby attracting the attention of the operator. On the other hand, assume that the originals are placed one by one on the glass platen 8 by a roller 20 using an automatic document feeder (ADF) and the copied original is discharged. In such a case, only the originals whose images have sufficient contrasts are copied and the originals whose image does not have sufficient contrast are not copied. The originals which cannot be copied are removed from the glass platen 8 by a roller 19 in response to the warning signal described above. Furthermore, when the copying operation for all the originals is completed, the number of the noncopied originals may be displayed. In response to a warning signal, control of a process means other than an exposure lamp can be performed so as to provide an optimal contrast.

What I claim is:

1. An image density control apparatus for controlling image processing procedures, comprising:

detection means for detecting a density of an image prior to image processing;

memory means for storing therein data representing the density detected by said detection means, said data being stored in relationship to a plurality of positions on an original; and control means for adjusting a condition for image processing corresponding to each of said plurality of positions on the original, in response to said data stored in relation to each said position on the original.

2. An image density control apparatus according to claim 1, wherein said control means adjusts the image processing condition in response to a calculation of an average of the entirety of the data stored in said memory means, and the data relating to each position on the original.

3. An image density control apparatus according to claim 2, wherein this calculation produces a difference between the average of the entirety of the data and the data relating to each position on the original.

4. An image density control apparatus according to claim 1, wherein said image processing is to expose an original, form a latent image corresponding to an original image onto a photosensitive member and develop the latent image, and wherein the condition for the image processing is that for exposure or that for development processing.

5. An image density control apparatus according to claim 1, wherein said detection means detects the density of the original image by detecting light quantity reflected from the original image.

6. An image density control apparatus comprising:

detection means for detecting a density of an original image;

adjusting means for adjusting a condition for an image formation in response to the density detected by said detection means;

discrimination means for discriminating whether a contrast of the density of the original image is suitable or not; and control means adapted to indicate the result from said discrimination means or restrain adjustment of the density by said adjusting means.

7. An image density control apparatus according to claim 6, wherein said control means is adapted to inhibit the output of control data for adjustment of the density when the contrast is not suitable.

8. An image density control apparatus according to claim 6, wherein said image formation is to expose an original, form a latent image onto a photosensitive member and develop the latent image, and wherein the condition for the image formation is that for exposure processing or that for development processing.

9. An image density control apparatus according to claim 6, wherein said detection means detects the density of the original image by detecting light quantity reflected from the original image.

* * * * *